US012669074B2

(12) United States Patent
Schwoerer et al.

(10) Patent No.: US 12,669,074 B2
(45) Date of Patent: Jun. 30, 2026

(54) VALVE ACTUATION SYSTEM FOR PROVIDING VALVE ACTUATION MOTIONS FOR LATE/EARLY INTAKE VALVE CLOSING AND INTERNAL EGR

(71) Applicant: Jacobs Vehicle Systems, Inc., Bloomfield, CT (US)

(72) Inventors: John A. Schwoerer, Storrs Mansfield, CT (US); Robb Janak, Bristol, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 18/655,294

(22) Filed: May 5, 2024

(65) Prior Publication Data

US 2024/0369003 A1 Nov. 7, 2024

Related U.S. Application Data

(60) Provisional application No. 63/500,440, filed on May 5, 2023.

(51) Int. Cl.

| | |
|---|---|
| ***F01L 9/10*** | (2021.01) |
| ***F01L 1/18*** | (2006.01) |
| ***F01L 13/00*** | (2006.01) |

(52) U.S. Cl.

CPC ..... *F01L 9/10* (2021.01); *F01L 1/181* (2013.01); *F01L 13/00* (2013.01)

(58) Field of Classification Search

CPC ..... F01L 9/10; F01L 1/181; F01L 2800/10

See application file for complete search history.

(56) References Cited

U.S. PATENT DOCUMENTS

| | | | |
|---|---|---|---|
| 7,392,772 | B2 | 7/2008 | Janak et al. |
| 9,790,824 | B2 | 10/2017 | Baltrucki et al. |
| 11,131,222 | B2 | 9/2021 | Schwoerer et al. |
| 2006/0005796 | A1 | 1/2006 | Janak et al. |
| 2012/0210964 | A1 | 8/2012 | Barnes |
| 2021/0262369 | A1 | 8/2021 | Schwoerer et al. |

OTHER PUBLICATIONS

International Search Report for International application No. PCT/US2024/027911; mailed Aug. 6, 2024; 3 pages.

(Continued)

*Primary Examiner* — Ngoc T Nguyen

(74) *Attorney, Agent, or Firm* — Jordan IP Law, LLC

(57) ABSTRACT

A valve actuation system comprises a first motion transfer mechanism operatively connected to a first valve actuation motion source providing at least main valve actuations to at least one intake engine valve. A second motion transfer mechanism is operatively connected to a second valve actuation motion source providing at least an LIVC and IEGR valve actuations. When a selectable coupling mechanism is operated in a first state, the main valve actuation is conveyed to the at least one intake engine valve via the first motion transfer mechanism. When the selectable coupling mechanism is operated in a second state, at least a portion of the main valve actuation is again conveyed to the at least one intake engine valve, and the LIVC and IEGR valve actuations are conveyed to the at least one intake engine valve via the second motion transfer mechanism, the coupling mechanism and the first motion transfer mechanism.

7 Claims, 6 Drawing Sheets

(56) References Cited

OTHER PUBLICATIONS

Written Opinion of the International Searching Authority for International application No. PCT/US2024/027911; mailed Aug. 6, 2024; 4 pages.

Fessler, Harald, and Marco Genova. "An electro-hydraulic"lost motion" VVA system for a 3.0 liter diesel engine." SAE transactions (2004): 1639-1649.

Edwards, S. P., G. R. Frankle, F. Wirbeleit, and A. Raab. "The potential of a combined Miller cycle and internal EGR engine for future heavy duty truck applications." SAE transactions (1998): 355-373.

VALVE ACTUATION SYSTEM FOR PROVIDING VALVE ACTUATION MOTIONS FOR LATE/EARLY INTAKE VALVE CLOSING AND INTERNAL EGR

FIELD

The present disclosure generally concerns valve actuation systems for use in internal combustion engines and, in particular, valve actuation systems for providing valve actuations for late/early intake valve closing and internal exhaust gas recirculation.

BACKGROUND

Valve actuation in an internal combustion engine is required for the engine to operate. Typically, valve actuation forces to open the engine valves (i.e., intake, exhaust or auxiliary engine valves) are conveyed by valve trains where such valve actuation forces may be provided by main and/or auxiliary motion sources. As used herein, the descriptor "main" refers to so-called main event engine valve motions, i.e., valve motions used during positive power generation in which fuel is combusted in an engine cylinder to provide a net output of engine power, whereas the descriptor "auxiliary" refers to other engine valve motions for purposes that are alternative to positive power generation (e.g., compression release braking, bleeder braking, cylinder decompression, cylinder deactivation, brake gas recirculation (BGR), etc.) or in addition to positive power generation (e.g., internal exhaust gas recirculation (IEGR), variable valve actuations (VVA), early exhaust valve opening (EEVO), early intake valve opening (EIVC), late intake valve closing (LIVC), swirl control, etc.).

In many internal combustion engines, the main and/or auxiliary motion sources may be provided by fixed profile cams, and more specifically by one or more fixed lobes or bumps which may be an integral part of each of the cams. Benefits such as increased performance, improved fuel economy, lower emissions, and better vehicle drivability may be obtained if the intake and/or exhaust valve timing and lift can be varied. The use of fixed profile cams, however, can make it difficult to adjust the timings and/or amounts of engine valve lift to optimize them for various engine operating conditions.

One method of adjusting valve timing and lift, given a fixed cam profile, has been to provide a "lost motion" or variable length device in the valve train linkage between a given engine valve and its corresponding cam. Lost motion is the term applied to a class of technical solutions for modifying the valve actuation motion defined by a cam profile with a variable length mechanical, hydraulic, or other linkage assembly. In a lost motion system, a cam lobe (whether in support of main or auxiliary operation) may provide the "maximum" motion (longest dwell and greatest lift) needed over a full range of engine operating conditions including, as required in some cases, for positive power generation operation and/or auxiliary operation. A variable length system may then be included in the valve train linkage, intermediate of the valve to be opened and the cam providing the maximum motion, to subtract or lose part or all of the motion imparted by the cam to the valve. Typically, such lost motion devices are controllable between an "extended," "locked" or motion conveying state and a "retracted," "unlocked" or motion absorbing state. During the motion conveying state, the lost motion device is maintained in a substantially rigid configuration (with allowances for lash adjustments) such that valve actuation motions applied thereto are conveyed to the corresponding engine valve(s). On the other hand, during the motion absorbing state, the lost motion device is permitted to absorb or avoid, i.e., "lose," at least some (up to and including all) of the valve actuation motions applied thereto, thereby preventing such valve actuation motions from being conveyed to the corresponding engine valve(s).

Valve actuation systems incorporating lost motion capability continue to be developed to provide ever greater valve actuation functionality and flexibility. However, increased cost, packaging, and size are factors that may often determine the desirability of such engine valve actuation systems. Valve actuation systems comprising lost motions components that overcome these limitations while still providing varied valve actuation functionality and flexibility would represent a welcome advancement of the art.

Valve actuation systems capable of providing combinations of auxiliary valve actuation motions, such as IEGR in combination with LIVC or EIVC, in addition to main valve actuation motions, while doing so in a reliable, cost-effective manner, would be welcome additions to the art.

SUMMARY

The instant disclosure describes various embodiments of a valve actuation system for actuating at least one engine valve in an internal combustion engine.

In a first embodiment, such a system comprises a first motion transfer mechanism operatively connected to a first valve actuation motion source and to the at least one intake engine valve, wherein the first valve actuation motion source is configured to provide at least a main valve actuation motion. A second motion transfer mechanism is operatively connected to a second valve actuation motion source, wherein the second valve actuation motion source is configured to provide at least a late intake valve closing (LIVC) valve actuation motion relative to the main valve actuation motion and an internal exhaust gas recirculation (IEGR) valve actuation motion. A selectable coupling mechanism is disposed between the first motion transfer mechanism and the second motion transfer mechanism. When the selectable coupling mechanism is operated in a first state, the main valve actuation motion is conveyed to the at least one intake engine valve via the first motion transfer mechanism. When the selectable coupling mechanism is operated in a second state, at least a portion of the main valve actuation motion is conveyed to the at least one intake engine valve via the first motion transfer mechanism, and the LIVC valve actuation motion and the IEGR valve actuation motion are conveyed to the at least one intake engine valve via the second motion transfer mechanism, the coupling mechanism and the first motion transfer mechanism.

In a second embodiment, such a system comprises a first motion transfer mechanism operatively connected to a first valve actuation motion source and to the at least one intake engine valve, wherein the first valve actuation motion source provides at least an early intake valve closing (EIVC) valve actuation motion. A second motion transfer mechanism is operatively connected to a second valve actuation motion source, wherein the second valve actuation motion source is configured to provide at least a main valve actuation motion and an internal exhaust gas recirculation (IEGR) valve actuation motion. A selectable coupling mechanism is disposed between the first motion transfer mechanism and the second motion transfer mechanism. When the selectable coupling mechanism is operated in a first state, the EIVC valve actuation motion provided by the first valve actuation motion source is conveyed to the at least one intake engine valve via the first motion transfer mechanism. When the selectable coupling mechanism is operated in a second state, at least a portion of the EIVC valve actuation motion is conveyed to the at least one intake engine valve via the first motion transfer mechanism, and the main valve actuation motion and the IEGR valve actuation motion are conveyed to the at least one intake engine valve via the second motion transfer mechanism, the coupling mechanism and the first motion transfer mechanism.

In both the first and second embodiments, the selectable coupling mechanism may comprise a selectable hydraulic actuator wherein the hydraulic actuator is retracted during the first state and is extended during the second state. Alternatively, the selectable coupling mechanism may comprise a selectable mechanical locking mechanism wherein the mechanical locking mechanism is unlocked during the first state and is locked during the second state.

In the first embodiment, when the selectable coupling mechanism is operated in the second state, a handoff may occur from the main valve actuation motion to the LIVC valve actuation motion. Similarly, in the second embodiment, when the selectable coupling mechanism is operated in the second state, a handoff may occur from the EIVC valve actuation motion to the main intake valve actuation motion.

In both the first and second embodiments, the IEGR valve actuation motion does not give rise to a handoff with the main valve actuation motion or the EIVC valve actuation motion, respectively.

Methods corresponding to the first and second embodiments are also described.

BRIEF DESCRIPTION OF THE DRAWINGS

The foregoing and other features and advantages will be discussed in detail in the following non-limiting description of specific embodiments in connection with the accompanying drawings, in which.

DETAILED DESCRIPTION OF THE PRESENT EMBODIMENTS

As used herein, the term "operatively connected" is understood to refer to at least a functional relationship between two components, i.e., that the claimed components must be connected (potentially including the presence of intervening elements or components) in a way to perform an indicated function.

Figure 1:
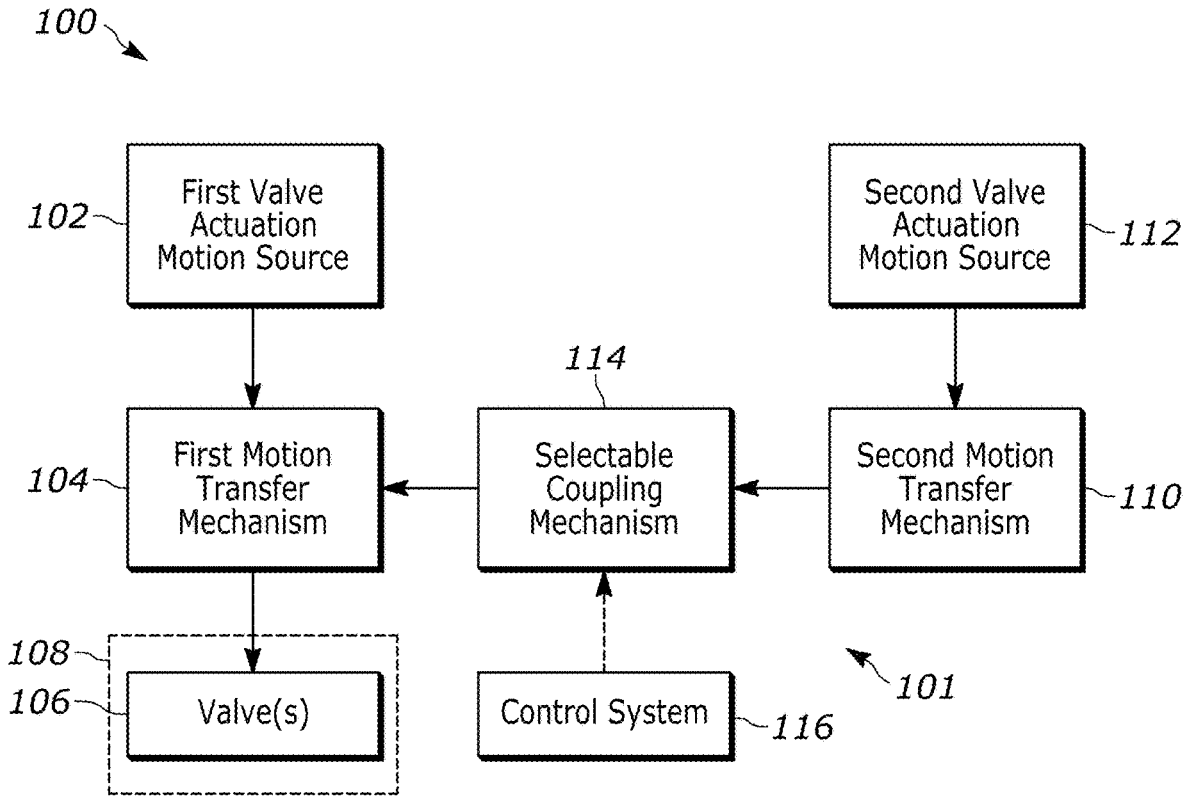
FIG. 1 is a schematic illustration of an internal combustion engine comprising a valve actuation system in accordance with the instant disclosure.

A schematic illustration of an internal combustion engine 100 comprising a valve actuation system 101 in accordance with the instant disclosure is shown with reference to FIG. 1. The valve actuation system 101 comprises a first motion transfer mechanism 104 operatively connected to a first valve actuation motion source 102 and configured to receive first valve actuation motions from the first valve actuation motion source 102. The first motion transfer mechanism 104 is also operatively connected to one or more engine valves 106 (associated with a cylinder 108 of the internal combustion engine 100) and configured to convey the first valve actuation motions to the at least one engine valve 106. As further shown, the valve actuation system 101 also comprises a second motion transfer mechanism 110 operatively connected to a second valve actuation motion source 112 and configured to receive second valve actuation motions from the second valve actuation motion source 112. A selectable coupling mechanism 114 is provided that permits selectable coupling of the second motion transfer mechanism 110 to the first motion transfer mechanism 104 under control of a control system 116 such that the second valve actuation motions may be applied to the at least one engine valve 106 via the second motion transfer mechanism 110, selectable coupling mechanism 114 and first motion transfer mechanism 104.

As known in the art, the engine valves 108 may comprise intake valves or exhaust valves and, in an embodiment, separate valve actuation systems 101 can be separately provided for different engine valve types associated with a single cylinder, e.g., one instance of a valve actuation system 101 for intake valves of the cylinder 108 and another instance of a valve actuation system 101 for exhaust valves of the cylinder 108. Although a single cylinder 108 is illustrated in FIG. 1 for ease of illustration, it is understood that the internal combustion engine 100 may, and typically will, comprise more than one such cylinder. Additionally, the implementation of the valve actuation motion sources 102, 112 and the motion transfer mechanisms 104, 110 may vary as known in the art. For example, the first and second motion transfer mechanisms 104, 110 may comprise Type III (center pivot) rocker arms equipped with cam rollers or tappets and operatively connected to corresponding cams. Alternatively, where the motion sources 102, 112 are provided by one or more overhead cams, the first and second motion transfer mechanisms 104, 110 may comprise Type II (end pivot) finger followers equipped with cam rollers contacting the corresponding overhead cams. In various embodiments, the selectable coupling mechanism 114 may comprise a hydraulically activated, one-way coupling mechanism that permits valve actuation motions applied to the second motion transfer mechanism 110 to be selectively conveyed to the first motion transfer mechanism 104, but that does not permit valve actuation motions applied to the first motion transfer mechanism 104 to be conveyed to the second motion transfer mechanism 110. Further still, where the coupling mechanism 114 is hydraulically controlled, the control system 114, which controls operating states of the coupling mechanism 114, may comprise a suitable engine control unit (ECU), as known in the art, in communication with one or more solenoid valves, also as known in the art. In this case, the ECU may control a solenoid valve to provide hydraulic fluid to, or to restrict flow of hydraulic fluid to, the coupling mechanism, thereby controlling its operating state.

Figure 2:
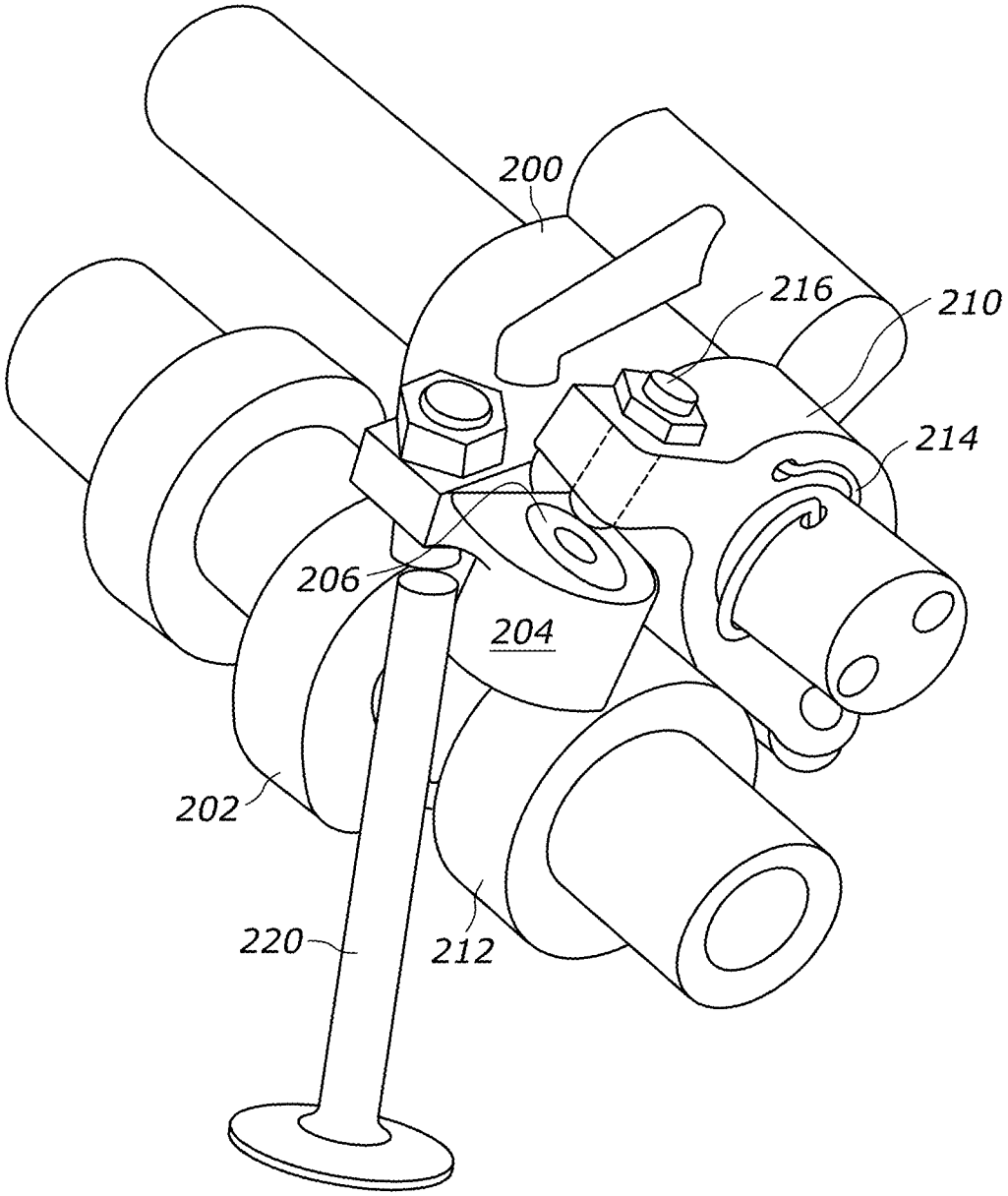
FIG. 2 is a perspective illustration of a first valve actuation system that may be used to implement teachings in accordance with the instant disclosure.

An implementation of the valve actuation system 100 may be found in U.S. Pat. No. 7,392,772 ("the '772 patent") and FIG. 2 illustrates the system described in the '772 patent. As shown in FIG. 2, a first/main rocker arm 200 is provided to convey main valve events, e.g., a main exhaust or intake valve event, received from a first valve actuation motion source (in this case, a cam) 202. In this embodiment, the coupling mechanism 114 is integrated into the first/main rocker arm 200, i.e., the first rocker arm 200 comprises a laterally extending boss 204 housing a coupling mechanism in the form of a hydraulically activated actuator 206 controlled via a control valve, as known in the art. Alternatively, the coupling mechanism may comprise a hydraulically activated mechanical locking mechanism as known in the art (e.g., as taught in U.S. Pat. No. 9,790,824) capable of being controlled to assume a locked or motion conveying state, or an unlocked or motion absorbing state. The system of FIG. 2 further comprises a second/auxiliary rocker arm 210 aligned to receive valve actuation motions from a second valve actuation motion source (again, a cam) 212. The second rocker arm 210 is also aligned with the boss 204 extending from the first rocker arm 200. A spring 214 is provided to bias the second rocker arm 210 into contact with the second valve actuation motion source 212 and away from the boss 204 such that lash or clearance space is provided between the boss 204 and a lash adjustment screw 216 disposed in a motion imparting end of the second rocker arm 200. During main event mode of operation of the engine, the actuator 206 is retracted into the boss 204, thereby preserving the lash between the first and second rocker arms 200, 210. In this manner, the second valve actuation motions provided by the second valve actuation motion source 212 are not conveyed from the second rocker arm 210 to the first rocker arm 200, i.e., they are "lost." On the other hand, when it is desired to add the auxiliary/second valve actuation motions to the first valve actuation motions, the actuator 206 is hydraulically controlled to extend from the boss 204 and take up the lash space such that the second rocker arm 210 contacts the actuator 206 and thereby conveys the second valve actuation motions to the first rocker arm 200.

Figure 3:
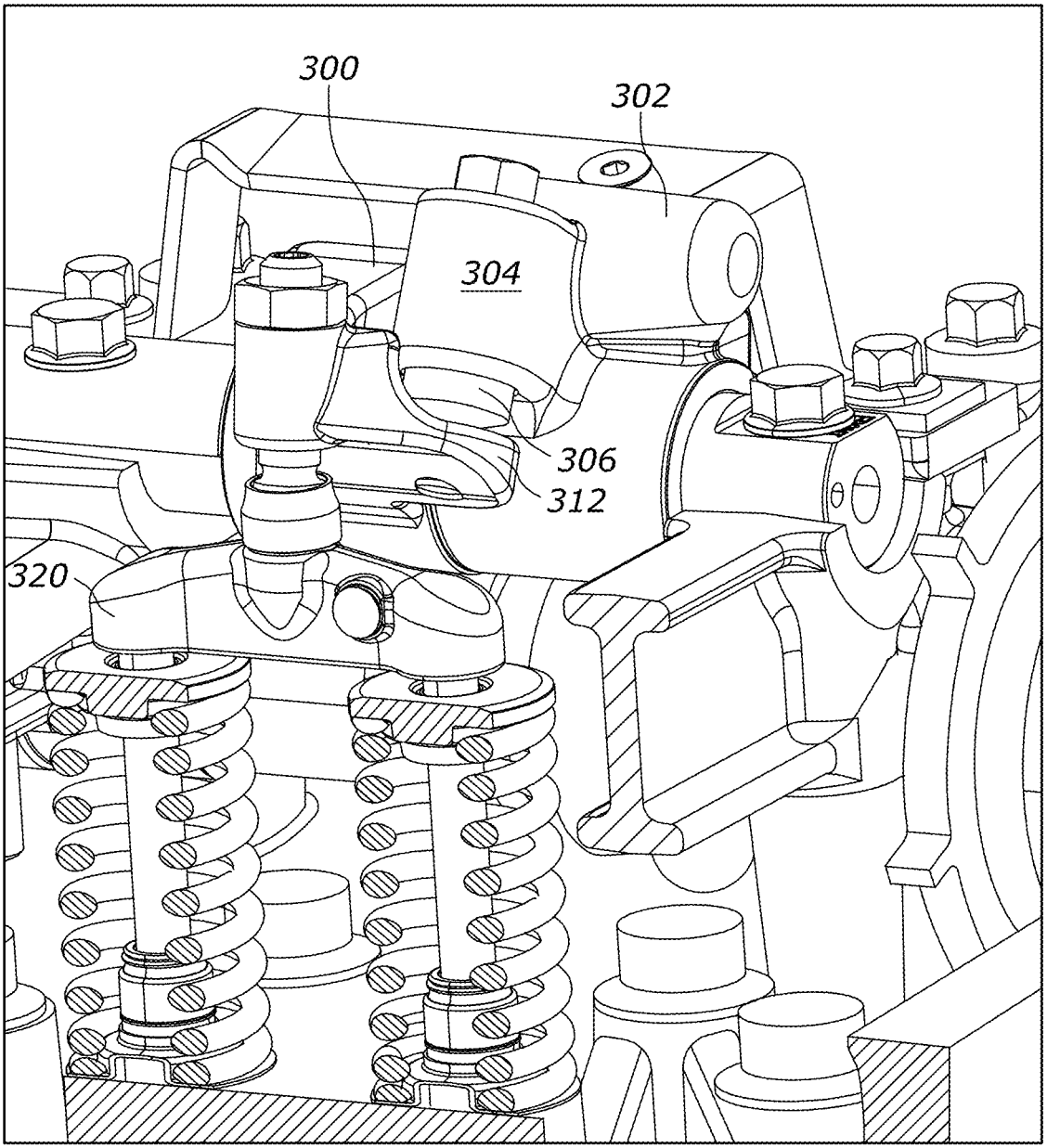
FIG. 3 is perspective illustration of a second valve actuation system that may be used to implement teachings in accordance with the instant disclosure.

FIG. 3 illustrates another example of a valve actuation system suitable for implementing the system illustrated in FIG. 1. In particular, the illustrated valve actuation system is substantially in accordance with the teachings of the '772 patent in that it comprises a first/main rocker arm 300 and a second/auxiliary rocker arm 302. In this embodiment, as shown in FIG. 3, the first rocker arm 300 contacts a valve bridge 320 at its motion imparting end. Further, the first and second rocker arms 300, 302 each comprise respective roller followers (not shown) disposed in their motion receiving ends, which roller followers receive valve actuation motions from respective first and second valve actuation motion sources implemented, once again in this case, as cams on a camshaft (not shown). Similar to the above-described embodiment from the '772 patent, the first and second rocker arms 300, 302 have a hydraulically-activated actuator (or hydraulically activated mechanical locking mechanism as noted above) 306 that may be controlled into a retracted position in which no valve actuation motions are conveyed from the second rocker arm 302 to the first rocker arm 300, or in an extended position in which valve actuation motions are conveyed from the second rocker arm 302 to the first rocker arm 300. However, unlike the embodiment illustrated in FIG. 2, the actuator 306 is not housed in the first rocker arm 300, but in a boss 304 formed in a motion imparting end of the second rocker arm 302. In order to receive valve actuation motions from the actuator 306, the first rocker arm 300 comprises a lateral extension 312 that aligns with boss 304 and actuator 306.

As noted previously, systems of the types illustrated in FIGS. 2 and 3 could be used to implement valve actuation systems in accordance with the instant disclosure, specifically to implement combination of IEGR, LIVC, and EIVC valve actuation operations. As taught in U.S. Pat. No. 11,131,222, LIVC valve actuations could be provided in a manner in which the first and second valve actuation motions cooperate with each other, i.e., the valve actuation motions provided by the separate motion sources overlap to provide a single, composite desired valve event, as opposed to separate, substantially non-overlapping valve events provided by the separate motion sources. Stated another way, separate valve actuation motion sources cooperate with each other or provide a handoff, as used herein, to the extent that valve actuation motions provided by the second valve actuation motion source can take over control of actuation of an engine valve at such a time when a first valve actuation motion source is already providing non-zero lift to the engine valve, or vice versa. In this manner, a second valve actuation motion source may add valve actuation motions to a main valve event to alter timing, lift or duration of the main valve event without requiring a discrete separate event from the main event.

In a first embodiment, the valve actuation systems illustrated in FIGS. 1-3 are configured to provide both IEGR and LIVC valve actuation motions, in addition to main intake valve actuation motions, to the engine valve(s) 106. This is achieved by having (with reference to FIG. 1, but also applicable to the systems of FIGS. 2 and 3) the first valve actuation motion source 102 configured to provide at least the main intake valve actuation motion, and having the second valve actuation motion source 112 configured to provide at least an LIVC valve actuation motion relative to the first valve actuation motion and to provide so-called IEGR pre-bump valve actuation motion. Further still, in an embodiment, the LIVC valve actuation motion is configured to establish a handoff with the main valve actuation motion as described in further detail below.

Figure 4:
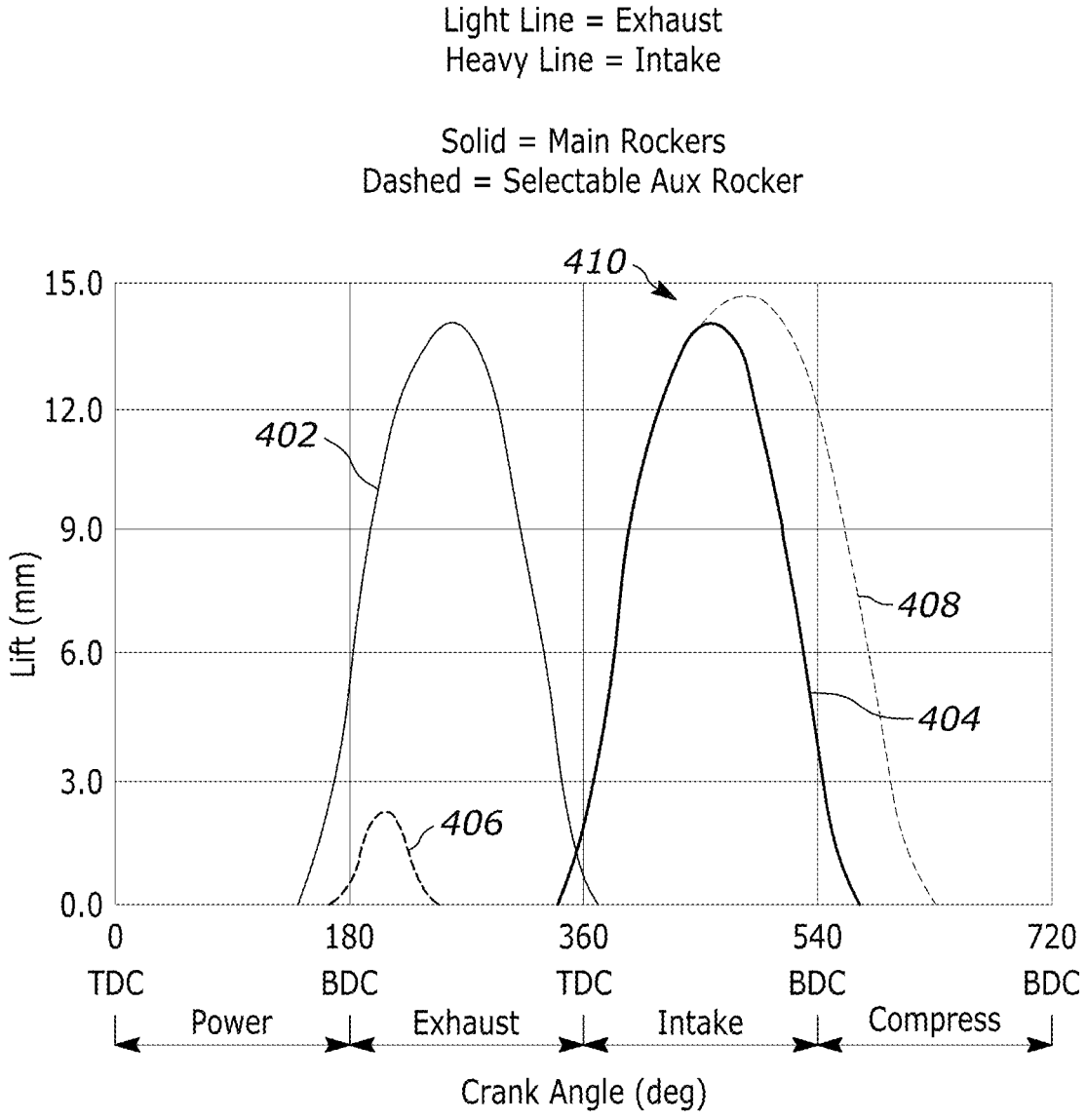
FIG. 4 is a graph showing representative valve lift profiles, particularly intake valve lift profiles in accordance with a first embodiment of the instant disclosure.

FIG. 4 illustrates embodiments of valve actuation motions provided by first and second valve actuation motion sources in accordance with the instant disclosure. In particular, FIG. 4 illustrates valve lifts (actuations) for both exhaust valves (curves shown with light lines) and intake valves (curves shown with heavy lines). Furthermore, the various intake-related lift curves are further distinguished in that valve actuation motions provided by a first valve actuation motion source 102 are illustrated with solid lines, whereas valve actuation motions provided by a second valve actuation motion source 112 are illustrated with dashed lines. With that understanding, FIG. 4 illustrates valve actuation motions comprising a main exhaust valve actuation motion 402 and a main intake valve actuation motions 404. Using valve actuation systems of the type illustrated in FIGS. 1-3, the main intake valve action motion 404 is provided by a first valve actuation motion source, whereas a second valve actuation motion source provides an IEGR valve actuation motion 406 and an LIVC valve actuation motion 408. As shown, the IEGR valve actuation motion 406 for one or more intake valves is provided at the same time as the main exhaust valve actuation motion 402, thereby facilitating exhaust gas recirculation as known in the art. Furthermore, as described above, the LIVC valve actuation motion 408 is configured such that a handoff 410 occurs between the main intake valve actuation motion 404 and the LIVC valve actuation motion 408, in this example, near the peak lift point during the opening phase of the main intake valve actuation motion 404. As will be appreciated by those having skill the art, while a specific handoff point 410 is illustrated, various other handoff points, e.g., during the closing phase of the main intake valve actuation motion 404, may be employed as a matter of design choice. Regardless, as shown, the LIVC valve actuation motion 408 provides late intake valve closing relative to the first or main intake valve actuation motion 404.

Figure 5:
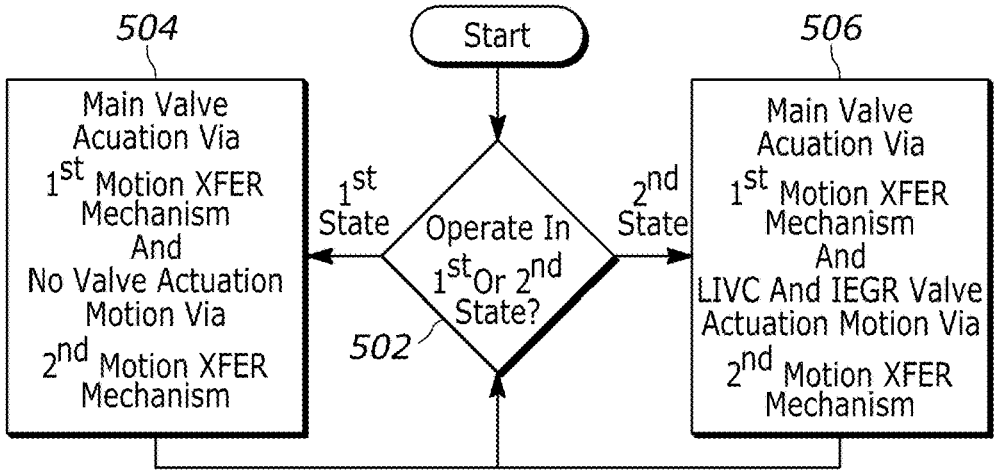
FIG. 5 is a flowchart illustrating operation of a system in accordance with the first embodiment of the instant disclosure.

Based on the valve actuation examples illustrated in FIG. 4, a method of actuating engine valves is described with reference to FIG. 5. In practice, the method illustrated in FIG. 5 may be implemented using, for example, the controller 116 as illustrated in FIG. 1. Beginning at block 502, a determination is made whether a request has been made to operate the engine is a first or second state. Such a determination may be made based on input provided by a user, e.g., a driver of vehicle, in accordance with known techniques (e.g., a user selectable switch in operative communication with the controller 116). Alternatively, such as determination may be based on detection of certain operating conditions (e.g., engine speed, engine torque, torque demand, aftertreatment temperature status, etc.) using sensors in communication with the controller 116 as known in the art. As used herein, the noted first and second states refer to operating states of the selectable coupling mechanism 114, where the first state corresponds to operation of the selectable coupling mechanism 114 in a retracted/unlocked/motion absorbing state and the second state corresponds to operation of the selectable coupling mechanism 114 in an extended/locked/motion conveying state.

If, at block 502, a determination is made that operation should proceed in accordance with the first state, processing continues at block 504 where, as noted above, the selectable coupling mechanism 114 is maintained in or switched to its retracted/unlocked/motion absorbing state. In the first state, according to this embodiment, at least one engine valve is operated according to the main intake valve actuation 404 as conveyed by the first motion transfer mechanism 104, whereas no valve actuation motions are conveyed to the at least one engine valve via the second motion transfer mechanism 110. The processing of steps 502 and 504 is continuously repeated so long as engine operation according to the first state is desired, or until a switch to the second operating state is detected.

When a determination is made at block 502 that the second operating state is desired, processing continues at block 506 where the selectable coupling mechanism 114 is maintained in or switched to its extended/locked/motion conveying state. In the second state, according to this embodiment, the at least one engine valve is again operated according to at least a portion of the main intake valve actuation 404 (i.e., that portion of the main intake valve actuation 404 occurring prior to the handoff 410) as conveyed by the first motion transfer mechanism 104. Additionally, the LIVC valve actuation motion 408 and IEGR valve actuation motion 406 are conveyed to the at least one engine valve via the second motion transfer mechanism 110, the selectable coupling mechanism 114 and the first motion transfer mechanism 104. In this case, the processing of steps 502 and 506 is continuously repeated so long as engine operation according to the second state is desired, or until a switch to the first operating state is detected.

In a second embodiment, the valve actuation systems illustrated in FIGS. 1-3 are configured to provide both IEGR and main intake valve actuation motions, in addition to EIVC valve actuation motions to the engine valve(s) 106. This is achieved by having (with reference to FIG. 1, but also applicable to the systems in FIGS. 2 and 3) the first valve actuation motion source 102 configured to provide an EIVC valve actuation motion, and having the second valve actuation motion source 112 configured to provide main intake valve actuation motion and an IEGR valve actuation motion.

Figure 6:
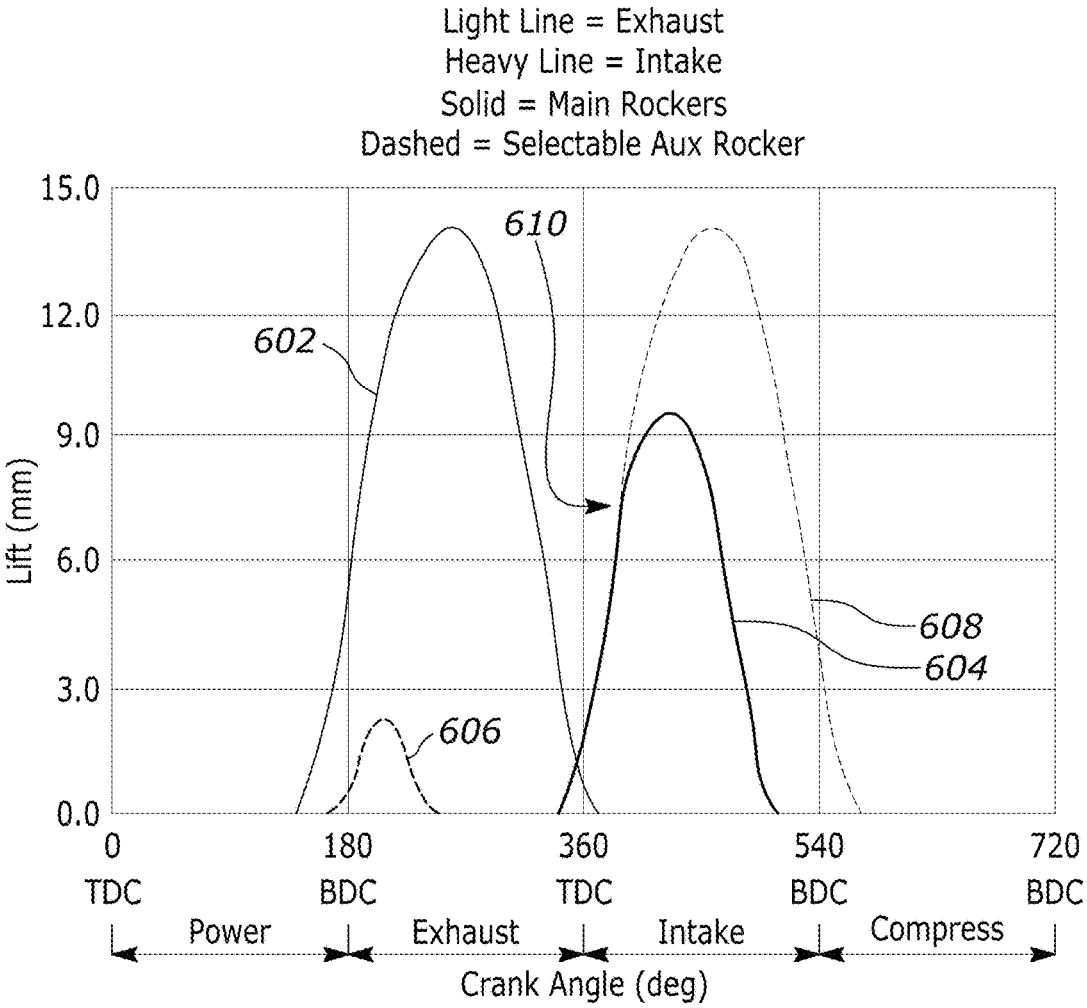
FIG. 6 is a graph showing representative valve lift profiles, particularly intake valve lift profiles in accordance with a second embodiment of the instant disclosure.

Using the same convention of light/heavy and solid/dashed curves as FIG. 4, FIG. 6 illustrates valve actuation motions comprising a main exhaust valve actuation motion 602. As noted, the EIVC valve action motion 604 is provided by a first valve actuation motion source, whereas a second valve actuation motion source provides the IEGR valve actuation motion 606 and the main intake actuation motion 608. In this example, the main intake valve actuation motion 608 is configured such that a handoff 610 occurs between the EIVC valve actuation motion 604 and the normal main intake valve actuation motion 608 at approximately two-thirds of the peak lift point during the opening phase of the EIVC valve actuation motion 604. Once again, the specific handoff point 610 may be selected elsewhere as a matter of design choice. As will be appreciated by those skilled in the art, the main intake valve actuation motion 608 in FIG. 6 is configured to be substantially similar, if not identical, to the main intake valve actuation motion 404 shown in FIG. 4, while nevertheless providing late intake valve closing relative to the EIVC valve actuation motion 604 shown in FIG. 6.

Figure 7:
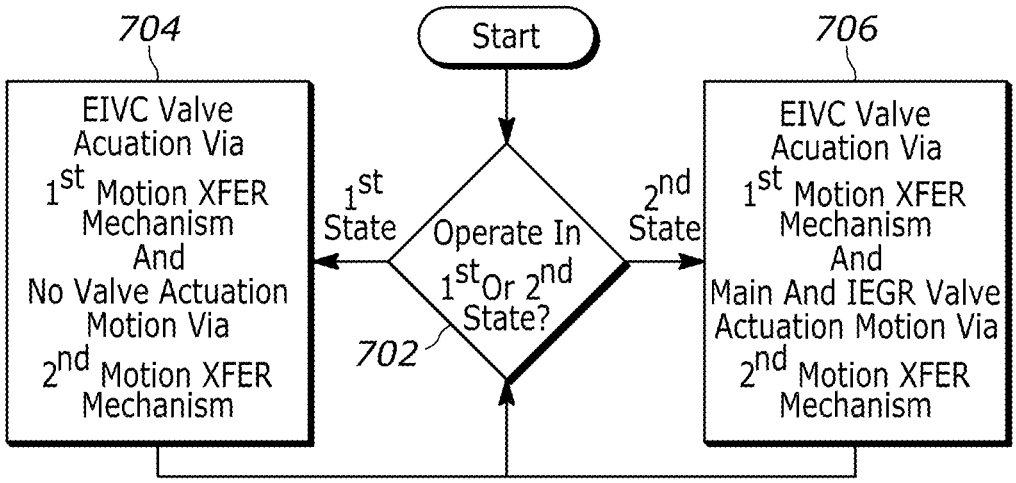
FIG. 7 is a flowchart illustrating operation of a system in accordance with the second embodiment of the instant disclosure.

Based on the valve actuation examples illustrated in FIG. 6, a method of actuating engine valves is described with reference to FIG. 7. Once again, in practice, the method illustrated in FIG. 7 may be implemented using, for example, the controller 116 as illustrated in FIG. 1. Beginning at block 702, a determination, as described above, is made whether a request has been made to operate the engine is a first or second state.

If, at block 702, a determination is made that operation should proceed in accordance with the first state, processing continues at block 704 where, as noted above, the selectable coupling mechanism 114 is maintained in or switched to its retracted/unlocked/motion absorbing state. In the first state, according to this embodiment, at least one engine valve is operated according to the EIVC intake valve actuation 504 as conveyed by the first motion transfer mechanism 104, whereas no valve actuation motions are conveyed to the at least one engine valve via the second motion transfer mechanism 110. The processing of steps 702 and 704 is continuously repeated so long as engine operation according to the first state is desired, or until a switch to the second operating state is detected.

When a determination is made at block 702 that the second operating state is desired, processing continues at block 706 where the selectable coupling mechanism 114 is maintained in or switched to its extended/locked/motion conveying state. In the second state, according to this embodiment, the at least one engine valve is again operated according to at least a portion of the EIVC intake valve actuation 604 (i.e., that portion of the EIVC intake valve actuation 604 occurring prior to the handoff 610) as conveyed by the first motion transfer mechanism 104. Additionally, the main valve actuation motion 608 and IEGR valve actuation motion 606 are conveyed to the at least one engine valve via the second motion transfer mechanism 110, the selectable coupling mechanism 114 and the first motion transfer mechanism 104. In this case, the processing of steps 702 and 706 is continuously repeated so long as engine operation according to the second state is desired, or until a switch to the first operating state is detected.

While the various embodiments in accordance with the instant disclosure have been described in conjunction with specific implementations thereof, it is evident that many alternatives, modifications and variations will be apparent to those skilled in the art. For example, while FIG. 1 and the implementation examples of FIGS. 2 and 3 illustrate valve actuation systems in which all valve actuation motions are conveyed to the at least one engine valve 106 via the first motion transfer mechanism 104 alone or in combination with the second motion transfer mechanism 110 and the selectable coupling mechanism 114, the techniques described herein need not be limited to such systems.

For instance, U.S. patent application Ser. No. 18/540,611 ("the '611 application), assigned to the same assignee as the instant application, describes valve actuation systems in which first and second rocker assemblies, each comprising a respective lost motion component, are provided such that individual control of valve actuation motions to respective engine valve is provided. More particularly, as illustrated and described in the '611 application with reference to FIGS. 1 and 2 therein, each of the first and second rocker assemblies comprise an input rocker and an output rocker with the respective lost motion component disposed in series between the input and output rocker. Additionally, a one way coupling mechanism is provided between the output rockers such that valve actuations provided by a main valve actuation motion source to the second output rocker are conveyed to the first output rocker, whereas valve actuation motions provided by an auxiliary valve actuation motion source to the first output rocker are not conveyed to the second output rocker.

If one views the first output rocker, the input rocker and the first lost motion component of the first rocker assembly in the '611 application as the first motion transfer mechanism 102, the second motion transfer mechanism 110 and the selectable coupling mechanism 114 of the instant application, respectively, the same combination of main, LIVC and IEGR valve actuations as described may be achieved. That is, when the first lost motion component of the '611 application is operated in its motion absorbing state, the first output rocker of the '611 application is provided with main valve actuation motions (via the second output rocker and one-way coupling), but is not provided with any auxiliary valve actuation motions (i.e., the LIVC and IEGR valve actuation motions). On the other hand, when the when the first lost motion component of the '611 application is operated in its motion conveying state, the first output rocker of the '611 application is provided with main valve actuation motions (again, via the second output rocker and one-way coupling) the any auxiliary valve actuation motions via the first input rocker of the '611 application.

Accordingly, the preferred embodiments of the invention as set forth herein are intended to be illustrative only and not limiting so long as the variations thereof come within the scope of the appended claims and their equivalents.

What is claimed is:

1. A valve actuation system for actuating at least one intake engine valve, the valve actuation system comprising:

a first motion transfer mechanism operatively connected to a first valve actuation motion source and to the at least one intake engine valve, wherein the first valve actuation motion source provides at least an early intake valve closing (EIVC) valve actuation motion;

a second motion transfer mechanism operatively connected to a second valve actuation motion source, wherein the second valve actuation motion source is configured to provide at least a main valve actuation motion and an internal exhaust gas recirculation (IEGR) valve actuation motion; and a selectable coupling mechanism disposed between the first motion transfer mechanism and the second motion transfer mechanism, wherein, when the selectable coupling mechanism is operated in a first state, the EIVC valve actuation motion provided by the first valve actuation motion source is conveyed to the at least one intake engine valve via the first motion transfer mechanism and, wherein, when the selectable coupling mechanism is operated in a second state, at least a portion of the EIVC valve actuation motion is conveyed to the at least one intake engine valve via the first motion transfer mechanism, and the main valve actuation motion and the IEGR valve actuation motion are conveyed to the at least one intake engine valve via the second motion transfer mechanism, the coupling mechanism and the first motion transfer mechanism.

2. The valve actuation system of claim 1, wherein the selectable coupling mechanism comprises a selectable hydraulic actuator and wherein the hydraulic actuator is retracted during the first state and is extended during the second state.

3. The valve actuation system of claim 1, wherein the selectable coupling mechanism comprises a selectable mechanical locking mechanism and wherein the mechanical locking mechanism is unlocked during the first state and is locked during the second state.

4. The valve actuation system of claim 1, wherein, when the selectable coupling mechanism is operated in the second state, a handoff occurs from the EIVC valve actuation motion to the main intake valve actuation motion.

5. The valve actuation system of claim 1, wherein the IEGR valve actuation motion does not give rise to a handoff with the EIVC valve actuation motion.

6. An internal combustion engine comprising the valve actuation system of claim 1.

7. In an internal combustion engine comprising a first motion transfer mechanism operatively connected to a first valve actuation motion source and to at least one intake engine valve, a second motion transfer mechanism operatively connected to a second valve actuation motion source and a selectable coupling mechanism disposed between the first motion transfer mechanism and the second motion transfer mechanism, a method for actuating the at least one intake engine valve comprising:

operating the selectable coupling mechanism in a first state where at least an EIVC valve actuation motion provided by the first valve actuation motion source is conveyed to the at least one intake engine valve via the first motion transfer mechanism; and operating the selectable coupling mechanism in a second state where, in addition to at least a portion of the EIVC valve actuation motion conveyed via the first motion transfer mechanism, second valve actuation motions provided by the second valve actuation motion source are conveyed to the at least one intake engine valve via the second motion transfer mechanism, the coupling mechanism and the first motion transfer mechanism, wherein the second valve actuation motions provided by the second valve actuation motion source comprise at least a main valve actuation motion and an internal exhaust gas recirculation (IEGR) valve actuation motion.

* * * * *